US006786458B1

(12) United States Patent
Slifkin

(10) Patent No.: US 6,786,458 B1
(45) Date of Patent: Sep. 7, 2004

(54) METHODS AND APPARATUS FOR TRUCK HUNTING DETERMINATION

(75) Inventor: Timothy P. Slifkin, Morristown, NJ (US)

(73) Assignee: Startrak, LLC, Morris Plains, NJ (US)

( * ) Notice: Subject to any disclaimer, the term of this patent is extended or adjusted under 35 U.S.C. 154(b) by 0 days.

(21) Appl. No.: 09/119,461

(22) Filed: Jul. 20, 1998

Related U.S. Application Data

(60) Provisional application No. 60/053,143, filed on Jul. 18, 1997.

(51) Int. Cl.[7] ..... B61L 13/04
(52) U.S. Cl. ..... 246/167 R
(58) Field of Search ..... 105/463, 165, 105/167, 168; 246/167 R, 169 R, 182 R, 182 A, 182 C

(56) References Cited

U.S. PATENT DOCUMENTS 4,393,957 A * 7/1983 Hawthorne ..... 184/3.1
5,222,440 A * 6/1993 Schneider ..... 105/453
5,622,338 A * 4/1997 Klink ..... 105/168
5,924,654 A * 7/1999 Anderson ..... 246/169 R

* cited by examiner

*Primary Examiner*—S. Joseph Morano
*Assistant Examiner*—Robert J. McCarry, Jr.
(74) *Attorney, Agent, or Firm*—Leo Stanger

(57) ABSTRACT

Truck hunting determination involves taking samples of side to side acceleration in a vehicle, evaluating the samples by comparing the samples, and determining the degree of truck hunting on the basis of the comparison.

36 Claims, 2 Drawing Sheets

IMPACT1 MONITOR UNIT

IMPACT1
MOUNTING CONFIGURATION

POSSIBLE TRACK/SWITCH PROBLEM (FEW LARGE PEAKS)
Accel
.75g
.5g
.25g
0g
-.25g
-.5g
.5 sec
1 sec
1.5 sec
2 sec
2.5 sec
Time POSSIBLE HUNTING SITUATION (MULTIPLE SIGNIFICANT PEAKS WITHIN SHORT TIME FRAME)
Accel
1.0g
.75g
.5g
.25g
0g
-.25g
-.5g
.5 sec
1 sec
1.5 sec
2 sec
2.5 sec
Time

METHODS AND APPARATUS FOR TRUCK HUNTING DETERMINATION

RELATED APPLICATIONS

This application is related to and a the regular application and continuation and/or continuation-in-part of Provisional Application Ser. No. 60/053,143 filed Jul. 18, 1997.

FIELD OF THE INVENTION

This invention relates to methods and apparatus for determination of truck hunting.

BACKGROUND OF THE INVENTION

The various means for determination of truck hunting, that is lateral movement, in railroad cars and other cargo carriers have depended on cumbersome and inaccurate arrangements which are difficult to transmit to remote locations.

DETAILED DESCRIPTION OF PREFERRED EMBODIMENTS

1. TRUCK HUNTING DETERMINATION 1.1. DEFINITION

Figure 1:
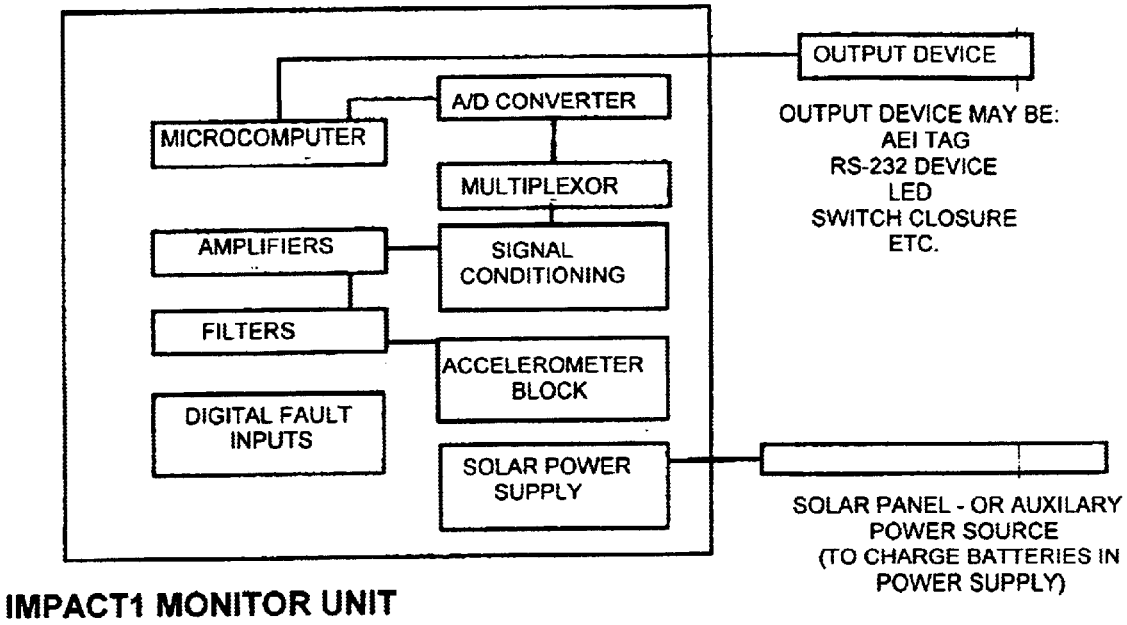
FIG. 1 is a schematic elevation of an embodiment of the invention in the form of a railroad car including equipment for truck hunting determination.
Figure 2:
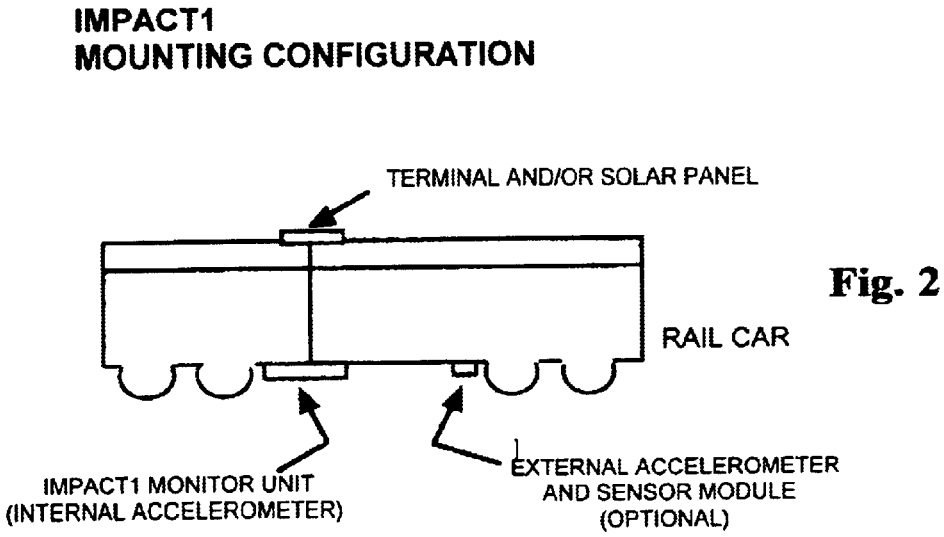
FIG. 2 is a schematic elevation of an embodiment of the invention showing a vehicle roof line with a solar panel
Figure 3:
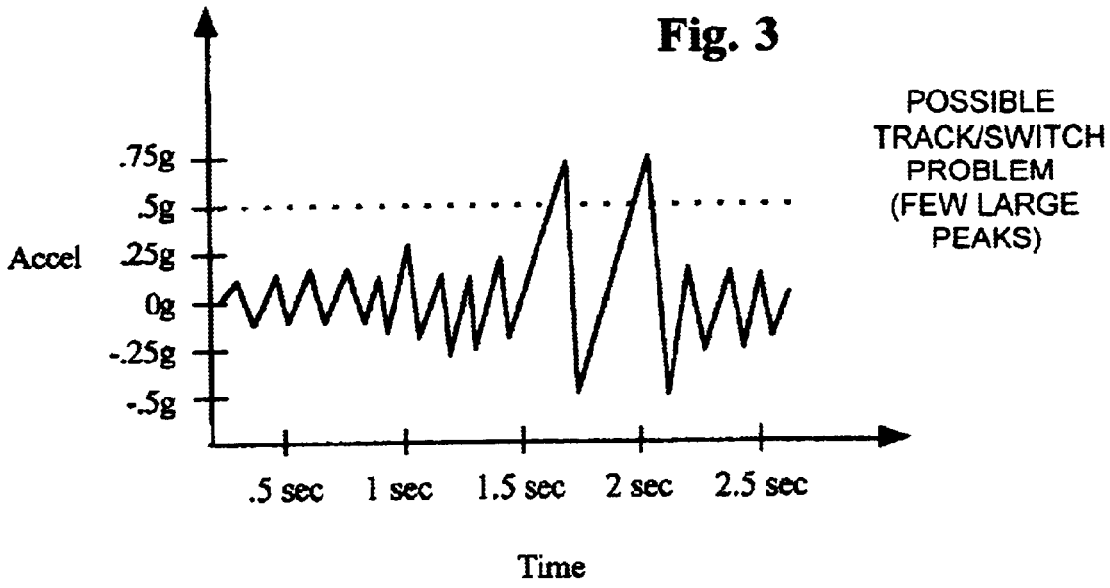
FIGS. 3 and 4 are graphs illustrating performance under various conditions.
Figure 4:
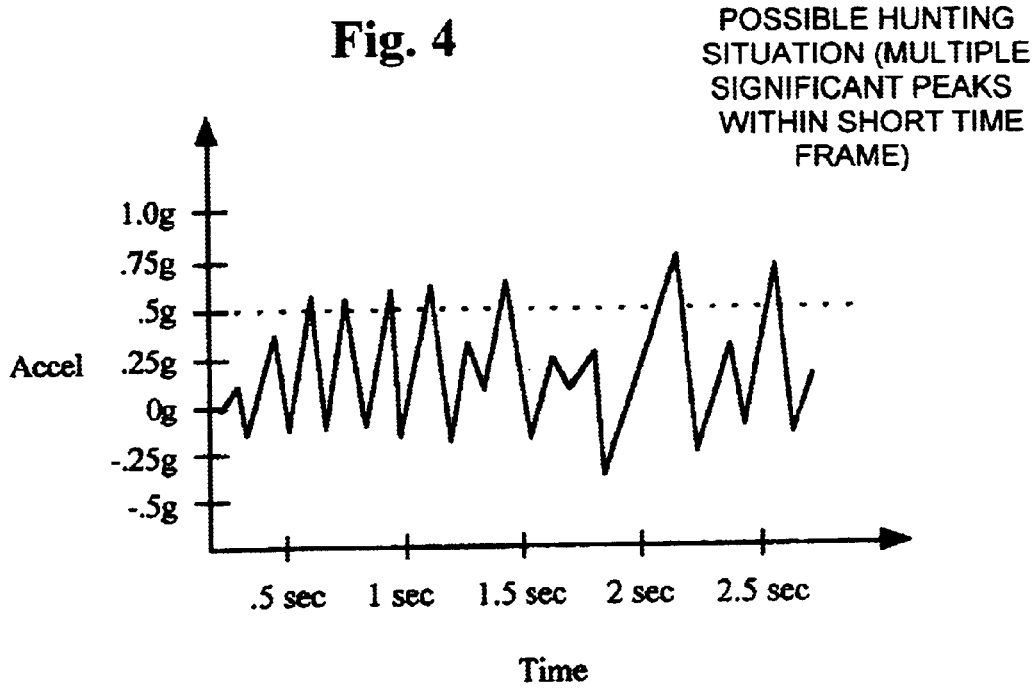

Truck hunting is defined as a lateral movement from side to side of a railcar. The AAR has set parameters for defining problematic truck hunting as 10 or more events of greater than 0.75 g at a rate of 2–6 Hz. Lower levels of events are indicative of degradation of railcar components, and could further degrade.

1.2. DETERMINATION

The aforementioned shaking leaves a measurable lateral signature on the y-axis accelerometer. This signature will be captured and monitored for evaluation under two different scenarios. The first deals with routine car health evaluation and monitoring, the second with truck hunting "events" in which the hunting exceeds certain levels.

1.2.1. IDENTIFICATION OF TRUCK HUNTING EVENTS

Two methods are available to capture this problem. They are:

1.2.1.1. Routine Monitoring

During the course of operation, the unit will be taking samples and evaluating them (see below). The comparison of energy and peaks over time is one way to determine the level of truck hunting.

1.2.1.2. Event Monitoring

The second method involves evaluating specific events that exceed certain set parameters. In this case, should the peak g exceed this number, then further analysis is done to determine whether it is a hunting event, or the car has gone over a piece of bad track.

The unit will take the 3 seconds buffer and an additional continuous 7 seconds (for a total of ten) and analyze the number of peaks over a set g to determine if there has been a hunting event, or something else.

1.2.2. TRUCK HUNTING HEALTH EVALUATION AND MONITORING 10 second y-axis samples will be taken periodically (2–4 times per hour) throughout the day, and only when the car is moving.

1.2.2.1. Sample Analysis

Each sample will have a number of peaks during the sample period. These peak numbers will be captured and stored in a database for eventual use in the truck hunting histogram. The data itself will be stored in the following format:

Date/time, speed, mass, peak1, peak2, peak3, peak4, peak5, peak6

Where:

Peak1=The number of peaks between 0.2–0.299 g

Peak2=The number of peaks between 0.3–0.399 g

Peak3=The number of peaks between 0.4–0.499 g

Peak4=The number of peaks between 0.5–0.599 g

Peak5=The number of peaks between 0.6–0.699 g

Peak6=The number of peaks at or above 0.7 g

These bins will be stored on-car until the car is queried (once or twice a month) and then compiled into two histograms: one for unloaded, one for when the car is loaded.

1.2.2.2. Truck Hunting Histogram

The histogram will have the number of peaks between these g levels within specific ranges of speed (see chart below).

| | 0.2–0.299 g | 0.3–0.399 g | 0.4–0.499 g | 0.5–0.599 g | 0.6–0.699 g | 0.7+ g |
|---|---|---|---|---|---|---|
| 10–19.9 mph | | | | | | |
| 20–29.9 mph | | | | | | |
| 30–39.9 mph | | | | | | |
| 40–49.9 mph | | | | | | |
| 50–59.9 mph | | | | | | |
| 60+ mph | | | | | | |

As the mass of the car may affect the hunting signature, at least two 36 bin histograms will be forwarded, one for when the car is unloaded, one for when the car is loaded. The addition of the two histograms together can all be done on the data server.

1.2.2.3. Trend Analysis

The forwarded histograms will then be compared to the historical histograms we have on file. And significant changes can be noted and forwarded to the customer. The specific changes that might signal a trend towards truck hunting include any move towards the right columns (i.e. higher peak g's).

1.2.3. ON-CAR PARAMETERS

One of the benefits to the RM7000 system is the two way communication and the fact that much of the analysis and parameters are dynamic. We can, therefore, remotely set the key parameters as we learn more about the functioning of the cars. The key remote-settable parameters are:

Sample frequency—The number of times per day (e.g. 2 times/hour) that a sample is taken Sample duration—The length of time (e.g. 10 seconds) that a sample lasts Alarm trigger—The peak g that must be exceeded (e.g. 0.5 g) for capture to start and for analysis to be done on the captured sample.

Bin parameters—Histogram parameters (speed and g ranges)

1.2.4. COMMANDS

Reset—Will reset/re-calibrate the data on-car. This is needed if a repair has recently been done, etc.

1.2.5. MESSAGES 1.2.6. ALARM—WAKE

The unit will automatically wake and capture data if y-axis peak g's exceed a certain level (i.e. 0.5 g). At this point the unit will save the buffer and capture for an additional period of time.

This analysis will evaluate whether there have been a number of peaks over certain levels within the sample period of time. These parameters will be set in a manner similar to the AAR definitions. For example:

If the number of peaks over 0.5 g is greater than some set number (5–10) then an alarm message is sent to the customer, alerting them to the potential problem.

1.2.7. ALARM—BAD SWITCH

If the peak exceeds some other number (e.g. 1 g) and seems to be a single event, then another alarm is sent, indicating that there was a bad switch, or perhaps a bad section of track or other anomaly.

Summary of Truck Hunting Health Determination Event Flow

| During Standard Monitoring | After Awakening from Trigger |
|---|---|
| Sample waveform (typically 10 seconds) is taken | Sample waveform is taken (3 seconds from buffer, 7 additional seconds, for total of 10) |
| Peak Analysis is performed (i.e. # peaks within each range of g [0.2–0.3, etc.]) | Peak Analysis is performed (i.e. # peaks within each range of g [0.2–0.3, etc.]) |
| Results are saved in database | |
| Results are saved in histogram | |
| Waveform analyzed to determine whether the frequency of significant peaks (i.e. those over some set number [typically 0.5 g]) is greater than some other set number (typically 2–6 Hz) | Waveform analyzed to determine whether the frequency of significant peaks (i.e. those over some set number [typically 0.5 g]) is greater than some other set number (typically 2–6 Hz) |
| Histogram analyzed for trends to determine potential degradation of performance | |
| If trend alarm triggered, then alarm and histogram sent to base station | |
| If not, histogram forwarded at set period (e.g. month end) | |
| If any peak exceeds some set number (typically 0.5 g), and frequency is not greater than trigger, then alarm is sent to base station regarding possible bad track section | If any peak exceeds some set number (typically 0.5 g), and frequency is not greater than trigger, then alarm is sent to base station regarding possible bad track section |
| Periodic geographic analysis done in central server to determine any possible track anomalies. | Periodic geographic analysis done in central server to determine any possible track anomalies. |

What is claimed is:

1. A method of sensing truck hunting, comprising:

taking samples of side to side acceleration in a vehicle;

comparing the samples with thresholds established from prior samples recorded within a plurality of ranges of speeds; and determining the degree of truck hunting on the basis of the comparison;

said determining step including counting the number of a plurality of peaks in the samples in each of the ranges of speeds that exceed the recorded thresholds in the range of speeds within a predetermined time period, and producing a signal indicative of a single truck hunting event when the counted number of the plurality of peaks in a range of speeds exceeds a given value.

2. A method as in claim 1, wherein said counting step includes counting the peaks over the predetermined periods for approximately 10 seconds.

3. A method as in claim 1, wherein the samples are transmitted to a station remote from the vehicle and the determining step occurs at the remote station.

4. A method as in claim 1, wherein the determining step occurs only for samples during predetermined intermittent periodic evaluating periods.

5. A method as in claim 1, wherein the predetermined intermittent period is approximately 10 seconds long and occurs between two to four times per hour.

6. A method as in claim 1, wherein the given frequency is approximately 2 Hz to 6 Hz.

7. A method as in claim 1, wherein the predetermined intermittent period is approximately 10 seconds long and occurs between two to four times per hour, and the given frequency is approximately 2 Hz to 6 Hz.

8. An apparatus for sensing truck hunting in a car, comprising:

a side-to-side accelerometer;

a microcomputer coupled to said accelerometer for counting accelerations within each of a range of speeds and within periods of time that exceed thresholds established from prior accelerations recorded in the same range of speeds; and an alarm for sending a signal when the counted accelerations within a time period reaches beyond a given number.

9. An apparatus as in claim 8, wherein said counter counts the peaks over periods the predetermined time of approximately 10 seconds.

10. An apparatus as in claim 8, wherein said alarm includes a transmitter to transmit the signal to a station remote from the car.

11. A method of sensing railroad faults, comprising:

taking samples of side to side acceleration in a vehicle for predetermined periods of time;

counting peaks of the samples that surpass a given level during the predetermined periods of time; and distinguishing excessive truck hunting events from other anomalies on the basis of the counting of the peaks;

said distinguishing step including sending a first signal when a plurality of the peaks that surpass a given level during the predetermined period exceeds a given frequency as a single truck hunting event, and sending a second signal when the peaks that surpass a given level occur within the sampling periods but do not exceed the given frequency.

12. A method as in claim 11 wherein the distinguishing step occurs only for samples during predetermined intermittent periodic distinguishing periods.

13. A method as in claim 11, wherein the predetermined period is an intermittent periodic distinguishing period approximately 10 seconds long, and occurs between two to four times per hour.

14. A method as in claim 11, wherein the given frequency is approximately 2 Hz to 6 Hz.

15. A method as in claim 11, wherein the predetermined period is an intermittent periodic distinguishing period approximately 10 seconds long and occurs between two to four times per hour, and the given frequency is approximately 2 Hz to 6 Hz.

16. A method as in claim 11, wherein said distinguishing step occurs only for samples during predetermined intermittent periodic distinguishing periods and the sampling includes transmitting the signal to a station remote from the vehicle.

17. An apparatus for truck hunting determination, comprising:

a side-to-side accelerometer;

a counter responsive to acceleration peaks that surpass a given level of said accelerometer within predetermined time periods; and an evaluator responsive to said counter for distinguishing between an excessive truck hunting event and other anomalies;

said evaluator sending a first signal when a plurality of the peaks that surpass a given level during the predetermined period exceeds a given frequency as indicating a single excessive truck hunting event, and sending a second signal when the peaks that surpass a given level occur within the sampling periods but do not exceed the given frequency as indicating a track anomaly.

18. An apparatus as in claim 17, wherein said accelerometer and said counter are in a car and the car includes a transmitter:

said apparatus further includes a station remote from the car, and said evaluator is at a station remote from the car.

19. A method of sensing truck hunting, comprising:

taking samples of side to side acceleration in a vehicle arranging the samples for a plurality of acceleration ranges of a plurality of speed ranges;

comparing the samples with thresholds established from prior samples for a plurality of acceleration ranges recorded within a plurality of ranges of speeds; and determining the degree of truck hunting on the basis of the comparison;

said determining step including sensing a shift to higher accelerations in a plurality of the samples in each of the ranges of speeds that exceed the recorded thresholds in the range of speeds within a predetermined time period, and producing a signal indicative of a single truck hunting event when the counted number of peaks in a range of speeds exceeds a given value.

20. A method as in claim 19, wherein said sampling step includes counting peaks of acceleration over the predetermined periods for approximately 10 seconds.

21. A method as in claim 20, wherein counting for approximately 10 seconds occurs a plurality of times per hour.

22. A method as in claim 19, wherein said determining step includes transmitting the signal to a station remote from the vehicle.

23. A method as in claim 19, wherein the determining step occurs only for samples during predetermined intermittent periodic evaluating periods.

24. A method as in claim 19, wherein the predetermined period is intermittent and periodic approximately 10 seconds long and occurs between two to four times per hour.

25. A method as in claim 19, wherein the given frequency is approximately 2 Hz to 6 Hz.

26. A method as in claim 19, wherein the predetermined period is intermittent and periodic and is approximately 10 seconds long and occurs between two to four times per hour, and the given frequency is approximately 2 Hz to 6 Hz.

27. A method of sensing railroad faults, comprising:

taking samples of side to side acceleration in a vehicle for predetermined periods of time;

sensing when a plurality of peaks of the samples that surpass a given level during the predetermined periods of time; and distinguishing truck hunting from other anomalies on the basis of the counting of the peaks;

said distinguishing step including sending a first signal indicative of an excessive truck hunting event when the plurality of peaks that surpass a given level during the predetermined period exceeds a given frequency of approximately 2 Hz to 6 Hz and sending a second signal indicative of track or other anomaly when the peaks that surpass a given level occur within the sampling periods but do not exceed the given frequency of approximately 2 Hz to 6 Hz.

28. A method as in claim 27, wherein the predetermined periods of time are approximately 10 seconds.

29. A method as in claim 27, wherein the taking of responds to an acceleration beyond a predetermined level.

30. A method as in claim 29, wherein the level is approximately 0.5 g.

31. A method as in claim 27, wherein said distinguishing step includes transmitting the samples to a station remote from the vehicle and performing the distinguishing at the remote station.

32. A method of monitoring truck hunting for a rail car on a track, comprising:

taking samples of side-to-side acceleration of the rail car during predetermined sampling periods;

in each sampling period evaluating peaks of the samples to determine whether the side-to-side accelerations result from an excessive truck hunting event or from an anomaly in the track;

the step of evaluating occurring only during predetermined intermittent periodic evaluating periods, and includes producing a first signal to indicate excessive truck hunting when the peaks that surpass the given level in one predetermined intermittent periodic evaluating period occur above a given frequency, and producing a second signal to indicate track anomaly when the peaks that surpass the given level in one predetermined intermittent periodic evaluating period occur below the given frequency; and transmitting the signals to a station remote from the rail car and the track.

33. A method as in claim 32, wherein the predetermined intermittent periodic evaluating period is approximately 10 seconds long and occurs between two to four times per hour.

34. A method as in claim 32, wherein the given frequency is approximately 2 Hz to 6 Hz.

35. A method as in claim 32, wherein the predetermined intermittent periodic is approximately 10 seconds long and occurs between two to four times per hour, and the given frequency is approximately 2 Hz to 6 Hz.

36. A method as in claim 32, wherein periodic geographic analysis performed on the transmitted signal in a central server to determine track anomalies.

* * * * *